United States Patent [19]

Burgoon

[11] 4,006,506

[45] Feb. 8, 1977

[54] SURFACE CLEANING MACHINE WITH SQUEEGEE ASSEMBLY

[75] Inventor: Jack L. Burgoon, Toledo, Ohio

[73] Assignee: The Scott & Fetzer Company, Lakewood, Ohio

[22] Filed: Feb. 10, 1975

[21] Appl. No.: 548,566

[52] U.S. Cl. ..... 15/50 R; 15/320; 15/359

[51] Int. Cl.[2] ..... A47L 11/30

[58] Field of Search ..... 15/50 R, 50 A, 50 C, 15/98, 320–322, 353, 354, 359, 340

[56] References Cited

UNITED STATES PATENTS

| | | | |
|---|---|---|---|
| 1,263,396 | 4/1918 | Faustini | 15/320 |
| 3,021,550 | 2/1962 | Stratford | 15/359 |
| 3,065,490 | 11/1962 | Arones | 15/359 |
| 3,290,716 | 12/1966 | Cain | 15/320 X |
| 3,496,591 | 2/1970 | Sheler | 15/320 |
| 3,550,181 | 12/1970 | Dolan et al. | 15/320 |
| 3,649,995 | 3/1972 | Ison | 15/320 |

FOREIGN PATENTS OR APPLICATIONS

| | | | |
|---|---|---|---|
| 1,100,266 | 1/1968 | United Kingdom | 15/320 |

*Primary Examiner*—Edward L. Roberts
*Attorney, Agent, or Firm*—Allen D. Gutchess, Jr.

[57] ABSTRACT

A surface or floor cleaning machine including scrubbing means and a following squeegee assembly is provided. The squeegee assembly includes a squeegee located near the rear of the machine and an arm pivotally connecting the squeegee to a frame of the machine between the squeegee and the scrubbing means at the forward end of the machine. A spring connects the squeegee arm and the machine near the pivot point to urge the arm and the squeegee downwardly. The squeegee has spaced wheels which movably support the squeegee blades on the surface to be cleaned so that the blades are not the sole support of the squeegee on the surface. In this manner, the squeegee blades are maintained firmly against the surface, even in uneven areas, while the wheels minimize the drag of the squeegee on the surface.

3 Claims, 5 Drawing Figures

FIG. 1
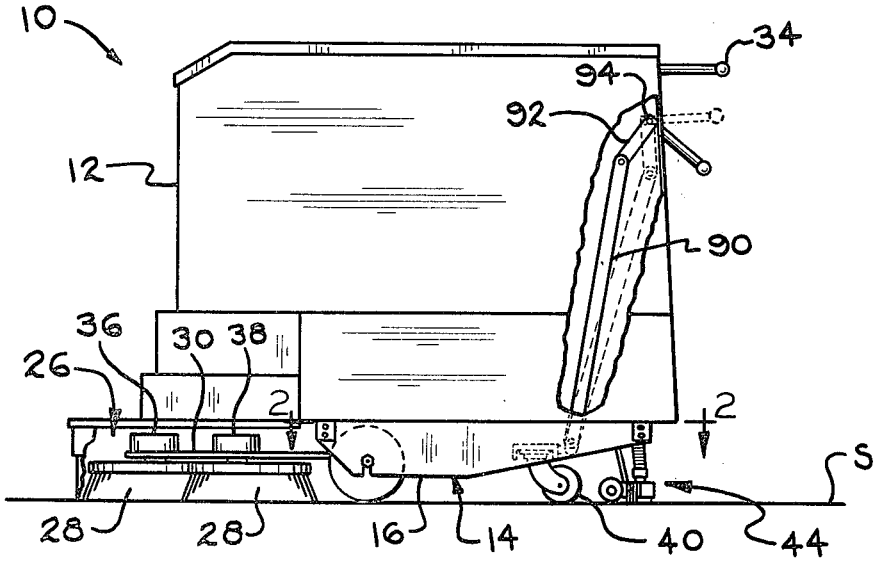
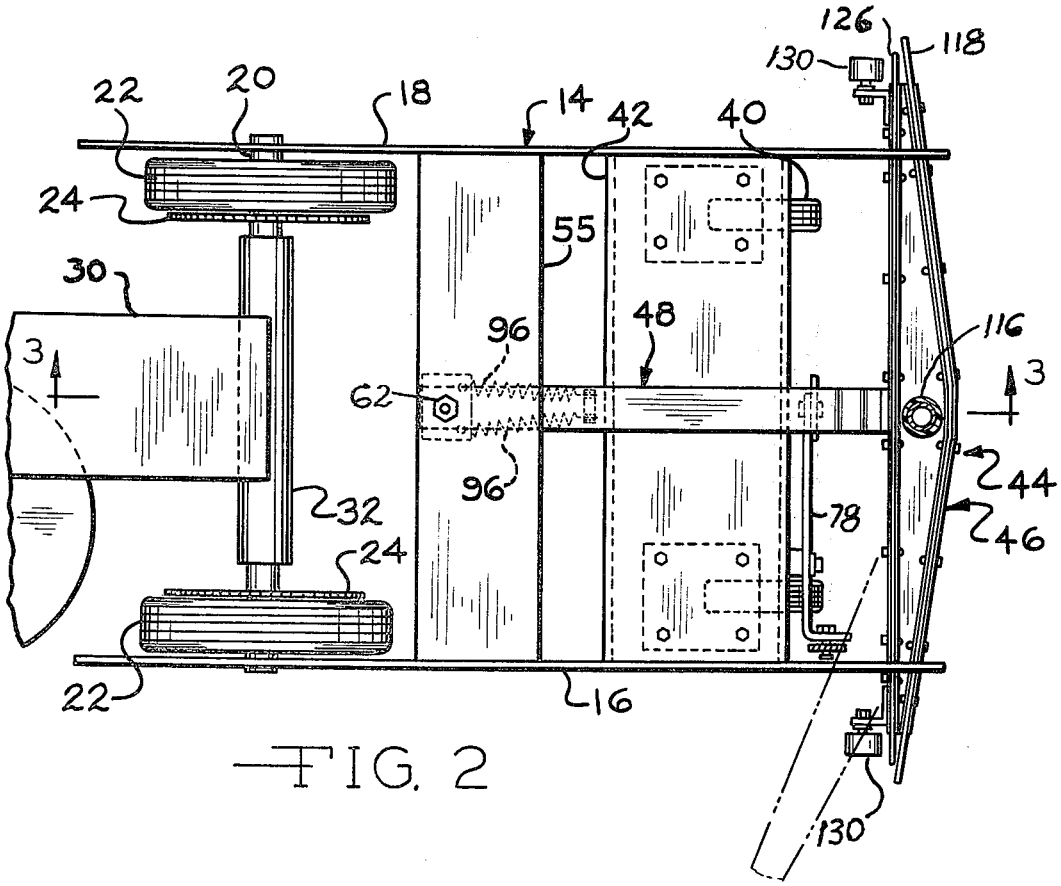
FIG. 2

SURFACE CLEANING MACHINE WITH SQUEEGEE ASSEMBLY

This invention relates to a surface or floor cleaning machine and more particularly to one with a following squeegee assembly.

Surface cleaning machines, particularly for commercial and industrial use, commonly have two power driven scrub brushes at the forward end of the machine. Cleaning solution from a tank on the machine is supplied to the brushes which deliver it to the surface. A squeegee is mounted at the rear of the frame for recovering dirty solution which is delivered to another tank on the machine. It is important that the dirty solution be removed from the floor to avoid spotty or dirty areas which otherwise result if the dirty solution is allowed to remain and evaporate. Squeegees heretofore known have often been less than effective in recovering all of the dirty solution. Streaks or puddles are frequently left, particularly in uneven areas or depressions in the surface or when protrusions exist. In addition, where the surface cleaning machine is maneuvered in various turns, the squeegee does not follow the surface strip being cleaned, thereby leaving side streaks or areas of the wet, dirty solution. If the squeegee is made sufficiently long to be assured of covering all of the wet strip left by the scrub brushes when the machine is being turned, then the protruding end of the squeegee frequently bump walls, posts, etc., resulting in damage.

A surface cleaning machine according to the invention employs a following squeegee assembly which includes a squeegee at the rear of the machine connected by an arm to a pivot point at an intermediate position in the machine, between the squeegee and scrub brushes at the forward end. During turns, the squeegee moves transversely and follows more closely over the wet strip left by the brushes and effectively removes the dirty solution from the strip without being of undue length.

Springs are connected between the squeegee arm and the machine below but near the pivot point of the arm thereby to urge downwardly the squeegee blades so that they can more effectively clean uneven areas, such as depressions and protrusions, of the surface. However, the squeegee is not supported on the surface directly through the squeegee blades but, rather, is supported by wheels mounted on the squeegee. The wheels movably support the squeegee on the surface with the squeegee blades in contact therewith but with the weight and downward force of the springs being carried to a substantial degree by the wheels. Thus, the squeegee blades will provide effective cleaning and yet the drag of the squeegee and specifically the squeegee blades on the surface is held to a minimum. The wheels are vertically adjustable to control the extent of contact of the squeegee blades with the surface.

It is, therefore, a principal object of the invention to provide a surface cleaning machine with a following squeegee which is mounted so that it will effectively follow the strip of the surface being cleaned by scrub brushes, even when the machine is moved in a tortuous path.

Another object of the invention is to provide a surface cleaning machine with a following squeegee having means urging the squeegee toward the surface being cleaned.

Still another object of the invention is to provide a following squeegee assembly having resilient means urging squeegee blades of the assembly toward the surface but having means for movably supporting the squeegee relative to the surface.

Still another object of the invention is to provide a squeegee assembly with a squeegee having wheels for rotatably supporting the squeegee blades relative to the surface to be cleaned and having means for vertically adjusting the wheels relative to the squeegee blades.

Many other objects and advantages of the invention will be apparent from the following detailed description of a preferred embodiment thereof, reference being made to the accompanying drawings, in which:

FIG. 1 is a side view in elevation, with parts broken away, of a surface or floor cleaning machine embodying the invention;

FIG. 2 is an enlarged view in horizontal section taken along the line 2—2 of FIG. 1;

Figure 3:
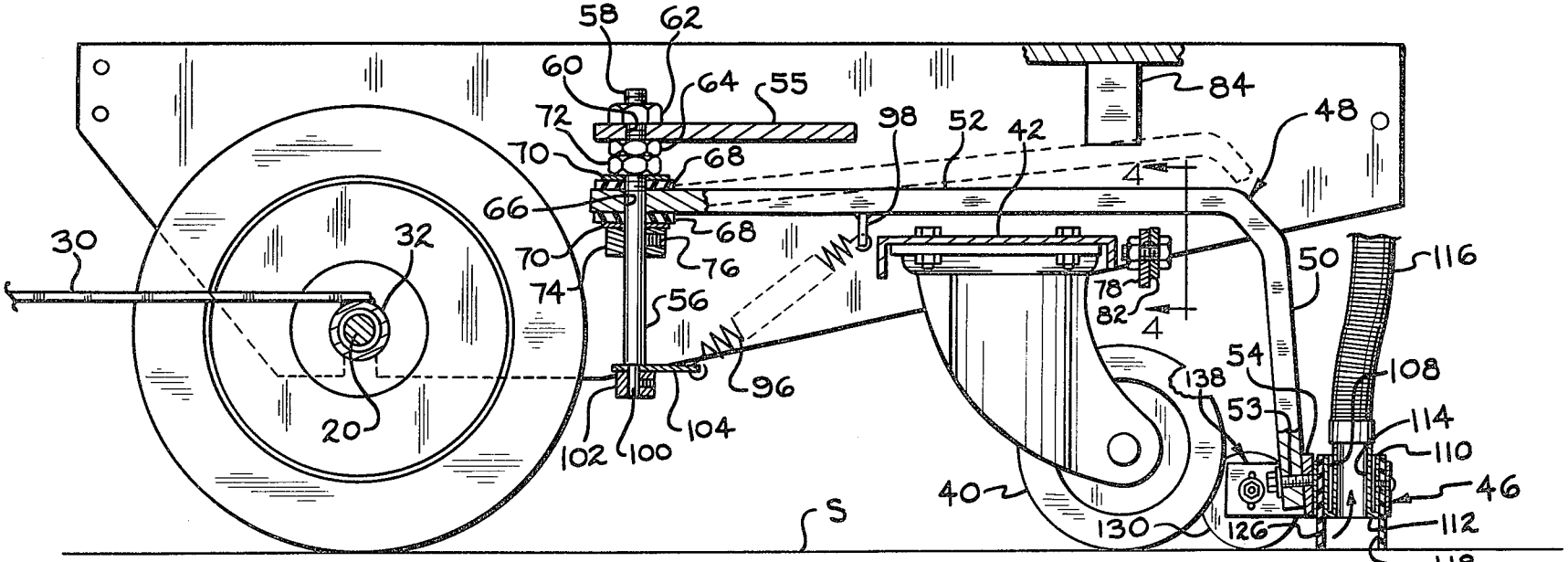
FIG. 3 is a further enlarged view in vertical cross section taken along the line 3—3 of FIG. 2.
Figure 5:
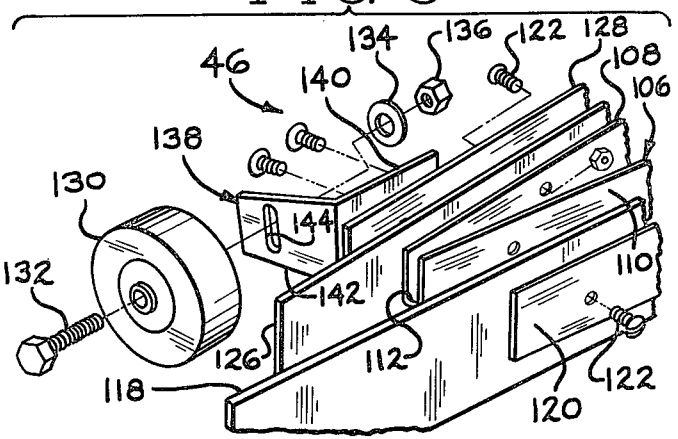
FIG. 5 is a fragmentary, exploded view in perspective of an end portion of a squeegee employed with the surface cleaning machine.

Referring particularly to FIGS. 1 and 2, a surface cleaning or floor scrubbing machine embodying the invention is indicated at 10. The machine includes a main housing 12 enclosing a cleaning solution tank, a dirty solution tank, and suitable power means. The housing 12 is mounted on a main frame 14 which includes side frame members 16 and 18 carrying an axle 20. Wheels 22 are located at end portions of the axle 20, and can be driven through sprockets 24.

A scrubbing unit 26 is located forwardly of the main frame 14 and includes two scrub brushes 28 which are supported from a platform 30. The platform 30 is pivotally mounted by a sleeve 32 on the axle 20 so that the scrub brushes can be raised and lowered by suitable mechanism which can extend to the rear of the machine 10 and be operated by an operator walking behind the machine. The operator can steer the machine and control the speed through suitable control handles 34. The scrub brushes 28 can be rotated through individual gear boxes 36 and 38 located above the platform 30 and driven by a motor (not shown) mounted on the platform. This motor can also drive the sprockets 24 for the wheels 22.

The machine 10 is also supported on rear casters 40 which are pivotally mounted on a cross frame bar 42 extending between the main frame members 16 and 18 and located below the bottom of the housing 12. When the machine 10 is steered, it tends to turn about a point on the axle 20.

A squeegee assembly 44 embodying the invention is also carried by the main frame 14 to the rear of the scrubbing unit 26. The squeegee assembly 44 includes a squeegee 46 mounted on an arm 48 extending forwardly therefrom in a symmetrical manner toward the scrubbing unit 26. As shown in FIG. 3, the arm 48 includes an upright end portion 50 and a generally horizontal portion 52 which extends above the cross frame bar 42 between the main frame members 16 and 18 so as to be able to pivot transversely beyond the casters 40, as shown by the dotted lines of FIG. 2. The lower end of the upright portion 50 is affixed to the squeegee 46 by a machine screw 53 threaded in a metal block 54 which is centrally affixed to the squeegee.

The forward end of the horizontal portion 52 of the arm 48 is pivotally mounted near the wheels 22 below a cross frame member or bar 55. For this purpose, a vertical pivot rod 56 has an upper threaded end 58 extending through an opening 60 in the frame member 55 with the rod 56 held in a fixed position by nuts 62 and 64. The horizontal portion 52 of the arm 48 has an end opening 66 therein which receives the pivot rod 56. Rubber washers 68 are located on opposite sides of the arm portion 52 with metal washers 70 located on opposite sides of the rubber washers 68. The washer assembly is held in place by a third nut 72 on the threaded portion 58 and by a lower collar 74 mounted on the pivot rod 56 by a setscrew 76.

With this arrangement, the arm 48 can pivot in a horizontal plane between the side frame members 16 and 18. The rubber washers 68 also enable the arm 48 to be moved vertically, to a dotted line position of FIGS. 3 and 4 to raise the squeegee 46 from the surface when the machine is being transported from one cleaning site to another.

Figure 4:
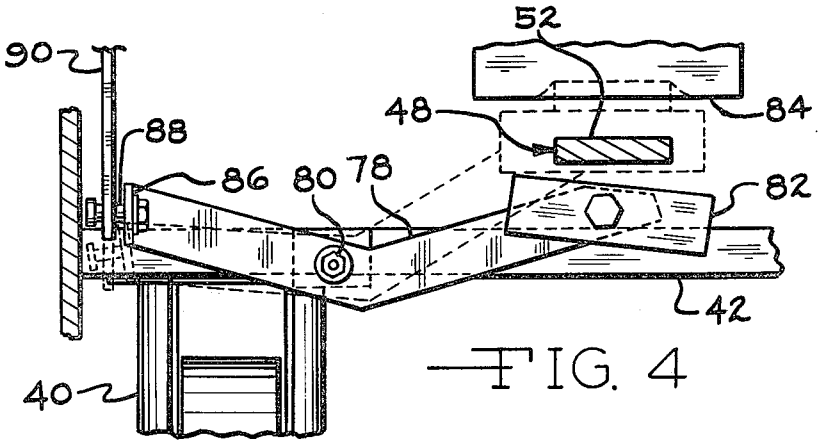
FIG. 4 is a detailed view taken along the line 4—4 of FIG. 3.

To raise the squeegee, referring to FIG. 4, a lever 78 is pivotally mounted by a pin or bolt 80 on the cross frame bar 42. The lever 78 has a contact bar 82 at one end which engages the horizontal portion 52 of the arm 48 to move it upwardly against a resilient pad 84 to raise the squeegee 46 above the surface. The opposite end of the lever 78 is pivotally connected through a flange 86 and a pin 88 to an upright operating link 90. Referring to FIG. 1, the link 90 is pivotally connected to an operating lever 92 pivoted at 94 to the side wall of the housing 12. When the lever 92 is moved from the solid line position to the dotted line position, the link 90 is moved downwardly sufficiently to rotate the lever 78 counterclockwise, as viewed in FIG. 4, to raise the arm 48.

Referring particularly to FIGS. 2 and 3, resilient means in the form of two coiled springs 96 are connected to an intermediate portion of the arm 48 between the pivot rod 56 and the cross bar 42, and specifically to a depending flange or tab 98 affixed to the lower surface of the horizontal portion 52 of the arm 48. The opposite ends of the springs 96 are connected below the portion 52 of the arm to the pivot rod 56. For this purpose, the pivot rod 56 has a lower end 100 of reduced diameter upon which is received a sleeve 102 having a collar 104 to which the spring ends are fastened. The force of the springs 96 holds the sleeve 102 and the collar 104 on the rod 56 against a shoulder formed by the reduced end 100 and the full diameter of the rod.

The springs 96 urge the arm 48 downwardly about the pivot rod 56 and also urge the squeegee 46 toward a surface designated S to be cleaned. This downward force enables the squeegee to more fully accommodate uneven areas in the floor and especially depressions and to also clean more effectively at small protrusions extending upwardly from the floor.

The squeegee 46 includes a U-shaped metal core 106 forming two upright legs 108 and 110 and a lower web 112. The web 112 tapers from a maximum width at the center to a minimum width at the ends where the core 106 almost comes to a point. At the center, the web 112 communicates with a metal upright nipple 114 which connects with a flexible exhaust duct 116 for all transverse positions of the squeegee 46. A rear flexible squeegee blade 118 is connected to the rear leg 110 of the core 106 by means of a metal strap 120 and suitable screws 122 and nuts 124 or other fasteners. A forward flexible squeegee blade 126, which is slightly shorter than the blade 118 is fastened to the forward leg 108 of the core 106 by a metal strap 128 and the screws 122 and the nuts 124.

In accordance with the invention, wheels 130 are mounted on spaced portions of the squeegee 46 to support the squeegee blades on the surface S to be cleaned. As shown, the wheels 130 are rotatably mounted by suitable screws 132, washers 134, and nuts 136 on L-shaped brackets 138. The L-shaped brackets have legs 140 which can be fastened to the metal strap 128 by the screws and nuts 122 and 124, the screws also extending through the blade 126 and the forward leg 108 of the core 106. The brackets 138 also have forwardly-extending legs 142 containing vertical slots 144 through which the screws 132 extend. With this arrangement, the wheels 130 can be vertically adjusted relative to the squeegee blades 118 and 126 to control the extent of contact of the blades with the surface S. The wheels 130 enable the springs 96 to forcefully urge the squeegee blades 118 and 126 toward the surface S and yet the wheels movably support the squeegee 46 on the surface to prevent undue drag of the squeegee 46 during the operation of the machine 10. Thus, the effectiveness of the squeegee in removing dirty solution through the duct 116 to the tank in the housing 12 is achieved without also resulting in undue drag of the squeegee on the surface.

In the operation of the machine 10, the cleaning solution applied to the brushes 28 is distributed over a strip of the surface S as the brushes rotate, preferably in opposite directions. The resulting wet and cleaned strip of the surface S is then passed over by the squeegee 46. At this time, the dirty solution is collected by the forward blade 126 and moved toward the center, in between the blades 118 and 126 where it is sucked up through the metal nipple 114 and the duct 116 into the dirty solution tank in the housing 12. Even when the machine 10 is turned by the operator through manipulation of the handle bar 34, the squeegee 46 will pivot accordingly so as to remain in alignment with the wet strip of the surface S. Hence, the edge portions of the wet strip will always be contacted by the squeegee blades and the dirty solution removed. Further, it is not necessary to have unduly long squeegee blades to accomplish this, as has heretofore been necessary.

Rather than the straight squeegee 46, a curved or arcuate squeegee having its center near the pivot rod 56 can be employed. In that instance, a third one of the wheels 130 is used, at the center of the squeegee near the arm 48.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A machine for cleaning a surface comprising a frame, a pair of forward wheels carried by said frame for movably supporting the machine on the surface, scrubbing means carried by said machine forwardly of said wheels for scrubbing a strip of the surface when moved thereover, a squeegee assembly comprising a squeegee, a single arm connected to a center portion of said squeegee, means pivotally connecting said arm to said machine with the pivot point being centrally located between the sides of the machine and behind said scrubbing means, spring means having an end connected below said arm near said arm pivot means and another end connected to said arm between said pivot means and said squeegee for urging said squeegee only toward the surface and not in a direction transverse to the direction of movement of the machine, two spaced wheels connected to said squeegee and engagable with the surface to be cleaned, means for vertically adjusting said wheels relative to said squeegee, and means carried by said machine for lifting said arm to raise the squeegee above the surface only when said arm extends substantially straight back from said pivot means.

2. A machine for cleaning a surface comprising a frame, forward wheels carried by said frame for movably supporting the machine of the surface, scrubbing means carried by said machine forwardly of said wheels for scrubbing a strip of the surface when moved thereover, a transverse frame bar extending across said machine therebelow and connected to said frame near the sides of said machine, at least one caster pivotally carried by an intermediate portion of said frame bar below said machine, a squeegee assembly comprising a squeegee, a single arm connected to a center portion of said squeegee, means pivotally connecting said arm to said machine with the pivot point being centrally located between the sides of the machines and between said scrubbing means and said frame bar, said arm having a portion positioned above said frame bar between said pivot means and said squeegee whereby said arm can pivot back and forth substantially between the sides of said machine and transversely-outwardly beyond said caster, spring means having an end connected below said arm near said arm pivot means and another end connected to said arm between said pivot means and said squeegee for urging said squeegee only toward the surface and not in a direction transverse to the direction of movement of the machine, two spaced wheels connected to said squeegee engagable with the surface to be cleaned, and means for vertically adjusting said wheels relative to said squeegee.

3. A machine for cleaning a surface comprising a frame, forward wheels carried by said frame for movably supporting the machine on the surface, scrubbing means carried by said machine for scrubbing a strip of the surface when moved thereover, a transverse frame bar extending across said machine therebelow and connected to said frame near the sides of said machine, two casters spaced apart and pivotally carried by an intermediate portion of said frame bar below said machine, a squeegee assembly comprising a squeegee, a single arm connected to a center portion of said squeegee, means pivotally connecting said arm to said machine with the pivot point being centrally located between the sides of the machines and between said scrubbing means and said frame bar, said arm having a portion positioned above said frame bar between said pivot means and said squeegee whereby said arm can pivot back and forth substantially between the sides of said machine and transversely-outwardly beyond each of said casters, spring means for urging said squeegee only toward the surface and not in a direction transverse to the direction of movement of the machine, and means carried by said machine for lifting said arm to raise the squeegee above the surface only when said arm extending substantially straight back from said pivot means.

* * * * *

UNITED STATES PATENT AND TRADEMARK OFFICE

CERTIFICATE OF CORRECTION

PATENT NO. : 4,006,506

DATED : February 8, 1977

INVENTOR(S) : Jack L. Burgoon

It is certified that error appears in the above-identified patent and that said Letters Patent are hereby corrected as shown below:

Column 1, line 28, add --s-- to "end".

Column 5, line 18, for "of" substitute --on--.

Column 6, line 33, for "extending" substitute --extends--.

Signed and Sealed this

Twelfth Day of April 1977

[SEAL]

*Attest:*

RUTH C. MASON
*Attesting Officer*

C. MARSHALL DANN
*Commissioner of Patents and Trademarks*